US005715805A

United States Patent [19]

Summers et al.

[11] Patent Number: 5,715,805

[45] Date of Patent: Feb. 10, 1998

[54] SINGLE AND DOUBLE BALL RELEASE NOCKS WITH SIGHT ALIGNMENT TAILS

[75] Inventors: Gregory E. Summers, 105 Overlink Ct., Lynchburg, Va. 24503; William G. Mayes, Monroe, Va.

[73] Assignee: Gregory E. Summers, Lynchburg, Va.

[21] Appl. No.: 781,149

[22] Filed: Jan. 9, 1997

Related U.S. Application Data

[63] Continuation-in-part of Ser. No. 705,546, Aug. 29, 1996.

[51] Int. Cl.[6] ..... F41B 5/18; F41B 5/14

[52] U.S. Cl. ..... 124/91; 124/35.2

[58] Field of Search ..... 124/35.2, 90, 91

[56] References Cited

U.S. PATENT DOCUMENTS

| | | | |
|---|---|---|---|
| 2,488,597 | 11/1949 | Konold | 124/35.2 |
| 2,777,437 | 1/1957 | Allen | 124/91 |
| 2,905,166 | 9/1959 | Niemeyer | 124/91 |
| 4,086,904 | 5/1978 | Suski et al. | 124/90 |
| 4,134,369 | 1/1979 | Cook | 124/35.2 |
| 4,151,825 | 5/1979 | Cook | 124/35.2 |
| 4,656,994 | 4/1987 | Jenks . | |
| 4,909,233 | 3/1990 | Stephenson | 124/91 |
| 4,930,485 | 6/1990 | Kopper | 124/91 |
| 4,981,128 | 1/1991 | Garvison | 124/35.2 |
| 5,016,603 | 5/1991 | Tentler | 124/91 |
| 5,170,771 | 12/1992 | Peck | 124/35.2 |
| 5,361,747 | 11/1994 | Laabs | 124/91 |
| 5,390,657 | 2/1995 | Larson | 124/91 |
| 5,499,620 | 3/1996 | Summers | 124/91 |
| 5,537,986 | 7/1996 | Summers | 124/91 |

*Primary Examiner*—John A. Ricci
*Attorney, Agent, or Firm*—Nixon & Vanderhye P.C.

[57] ABSTRACT

A single ball release nock for a bowstring is adapted for use with a single ball release device. The ball release nock includes a first ball portion having a first bowstring groove extending in a first direction; and an alignment tail portion adapted for interengagement with the ball portion and having a second bowstring groove adapted to cooperate with the first bowstring groove to form an elongated bowstring aperture. The alignment tail portion includes a tail projecting in a direction parallel to the bowstring aperture and extending beyond the ball portion in the first direction. A second embodiment includes a second ball portion at the opposite end of the tail portion for use with a double ball release device.

12 Claims, 8 Drawing Sheets

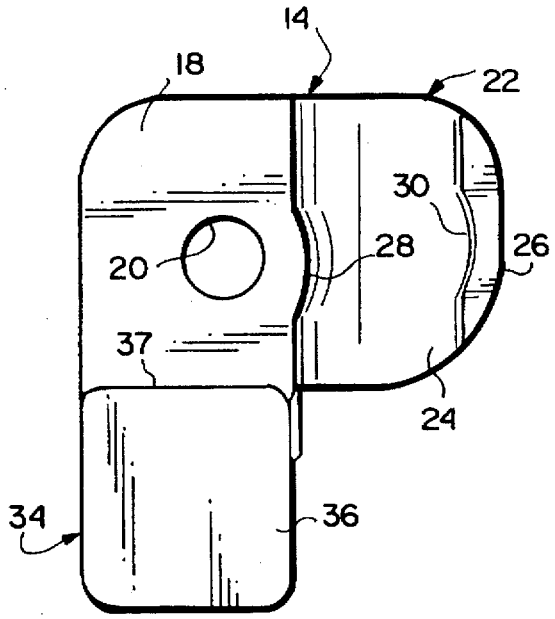
Fig.3
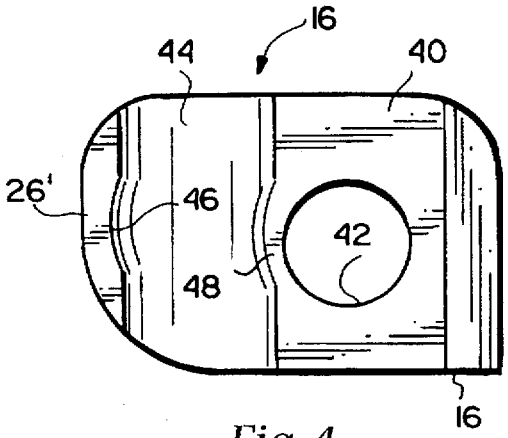
Fig.4
Fig.5
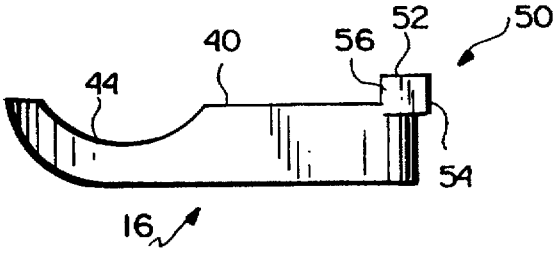
Fig.6
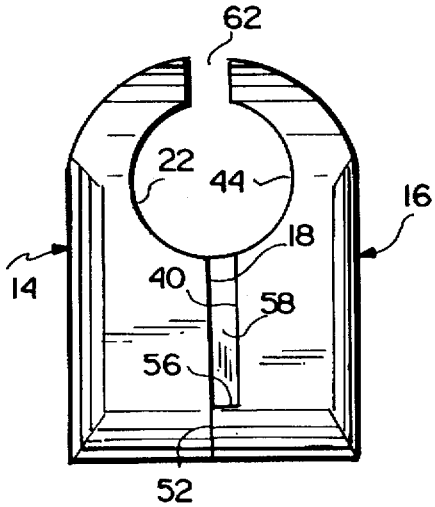

SINGLE AND DOUBLE BALL RELEASE NOCKS WITH SIGHT ALIGNMENT TAILS

RELATED APPLICATIONS

This is a continuation-in-part of application Ser. No. 08/705,546 filed Aug. 29, 1996.

TECHNICAL FIELD

This invention relates to bowstring nocks and bowstring release nocks which serve not only to position the tail end of an arrow on a bowstring, but also serve to aid in the vertical alignment of a peep sight device also secured to the bowstring.

BACKGROUND OF THE INVENTION

In the field of archery, it is conventional for an arrow to be provided with a string engaging fork, also known as an arrow nock, at the rear end of the arrow. It is also known to provide a bowstring nock which locates the arrow nock on the bowstring to facilitate good aim of the arrow. Accordingly, the bowstring nock must be located on the bowstring substantially at the center of the string, i.e., midway between the bowstring ends but slightly offset to accommodate the arrow which is on center, and substantially horizontally aligned with the point at which the forward end of the arrow is supported at the center of the bow. The bowstring nock may be located above or below the arrow nock. Representative bowstring nocks are described, for example, in U.S. Pat. Nos. 5,361,747; 4,909,233; and 2,905,166.

It is also known to provide various forms of hand held gripping and firing devices designed to cooperate with the bowstring nock or the bowstring itself, that enable an archer to apply a strong pull to the bowstring and release the arrow without having to grip the end of the arrow and the bowstring with the fingers. See, for example, U.S. Pat. Nos. 5,016,603 and 4,930,485.

One difficulty with conventional brass arrow nocks which are located above the arrow on the bowstring, and used in combination with a release device that engages the bowstring below the arrow, is the upward force exerted on the bowstring nock as the string is pulled to a fully drawn position. Oftentimes, the upward forces on the nock cause the latter to move upwardly along the bowstring thus causing a general misalignment of the arrow.

It is also conventional practice to mount a peep sight on the bowstring, and to keep the sight in proper rotational alignment with the aid of a small diameter rubber tube which is typically attached between the bowstring and, in the case of a compound bow, a pulley cable. The robe thus tends to keep the bowstring from rotating and thus misaligning the sight. While this arrangement is satisfactory from the standpoint of aligning the peep sight, it has been shown to slow the speed of the bowstring by as much as 6 to 15 feet per second.

SUMMARY OF THE INVENTION

It is the principal objective of this invention to provide a new bowstring nock, as well as single and double ball release nocks which embody several advantageous features relating not only to the conventional nock function vis-a-vis the arrow, but which also aid in the alignment of the peep sight device, thus eliminating the need for the previously used rubber tube.

In one exemplary embodiment of the invention, a two-piece bowstring nock is provided which, when assembled on the bowstring, has a downwardly (i.e., vertically as a frame of reference when the bow is in position for firing) extending tab which allows the archer to visually align the peep sight device with the bowstring nock. This alignment assures generally that when the bowstring is pulled rearwardly to a fully drawn position, the peep sight device will be in the correct rotational alignment. In the event of some slight rotation of the bowstring upon draw, the archer can compensate by loosening and rotating the nock slightly in the appropriate direction, recognizing that upon full draw, the peep sight will be correctly aligned. Thus, the bowstring nock of this invention not only serves to locate the arrow along the length of the bowstring, but also allows the user to visually align the peep sight device, while at the same time, this alignment tab assists in the proper location of the arrow nock in that the tab extends downwardly into the slot defined by the laterally spaced portions of the arrow nock.

It is another feature of this invention that the pair of half grooves located in the two bowstring nock sections, contain a machined detent which causes the nock, when assembled to the bowstring, to bite into the bowstring and therefore prevent unwanted upward or downward movement of the nock along the bowstring.

It is another feature of this invention that the forward end of the nock has a generous radius at its forward edge which lies adjacent the arrow nock, referred to herein as a rocker radius. This provides a smooth transition at the arrow and bowstring nock interface, eliminating any unwanted biting of the bowstring nock into the arrow nock as the bowstring is pulled rearwardly to the fully drawn position.

It is also a feature of the present invention to form the bowstring nock sections, and to connect the two nock sections with a screw fastener, in such a way that the two nock sections apply spring tension to the screw as the latter is tightened, thereby precluding loosening of the screw during use.

It is another object of this invention to provide single and double ball release nocks for use with release devices of the type disclosed in co-pending, commonly owned application Ser. No. 08/395,435 filed Feb. 28, 1995 and Ser. No. 08/422,537 filed Apr. 14, 1995 which are incorporated herein by reference. The release nocks in accordance with this continuation-in-part application are provided with peep sight alignment tails generally similar to that described above in connection with the conventional bowstring nock.

Accordingly, in accordance with this continuation-in-part application, there is provided a ball release nock for a bowstring adapted for use with a bowstring release device, the ball release nock comprising a first ball portion having a first bowstring groove extending in a first direction; an alignment tail portion adapted for interengagement with the ball portion and having a second bowstring groove adapted to cooperate with the first bowstring groove to form an elongated bowstring aperture; and wherein the alignment tail portion includes a tail projecting in a direction parallel to the bowstring aperture and extending beyond the ball portion in the first direction.

Other objects and advantages of the subject invention will become apparent from the detailed description which follows.

BRIEF DESCRIPTION OF THE DRAWINGS

FIG. 3 is a front elevation of the bowstring nock shown in FIG. 2, but mounted on a bowstring;

FIG. 4 is an exploded perspective view of the two parts which make up the bowstring nock in accordance with this invention;

FIG. 5 is a side elevation of one part of the nock;

FIG. 6 is a side elevation of the remaining part of the nock;

DETAILED DESCRIPTION OF THE DRAWINGS

Figure 1:
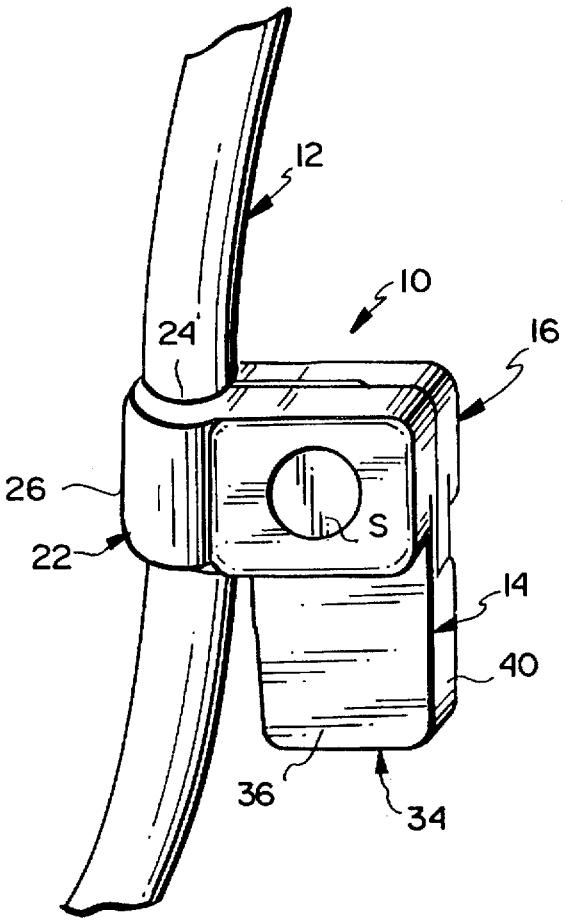
FIG. 1 is a partial perspective of a bowstring and bowstring nock in accordance with this invention.
Figure 2:
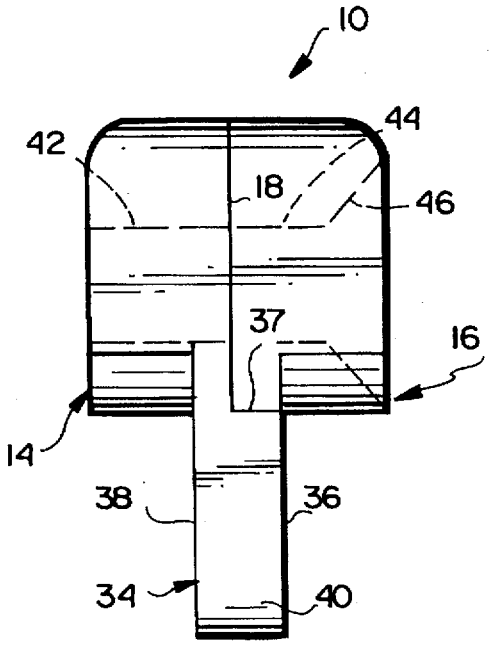
FIG. 2 is a rear elevation of the bowstring nock shown in FIG. 1.

Referring now to FIG. 1, a bowstring nock 10 in accordance with this invention is shown mounted on a bowstring 12. The bowstring nock 10 is generally comprised of two component parts or half sections 14 and 16 (preferably 7075 aircraft aluminum or other suitable material such as plastics or other metals), secured by a fastener such as the screw S. Referring also to FIGS. 2 and 3, the bowstring nock component part 14 includes a flat assembly face 18, formed with a threaded fastener aperture 20. A bowstring engaging portion 22 extends away from the assembly face 18 and is formed with a half groove 24 located between a forward edge 26 of the nock and the fastener aperture 20. The half groove 24 is generally semi-cylindrical but is also provided with detents 28 and 30 which assist in clamping the bowstring and bowstring nock together as explained in further detail below.

A vertically oriented sight tab 34 also extends away from the face 18, but in a direction transverse to the direction of extension of the mounting portion 22. As best seen in FIG. 2, the sight tab 34 has opposed faces 36, 38 connected by an edge 40. This sight tab is laterally offset from the assembly face 18 (see FIGS. 2 and 8) so that when the two nock components 14 and 16 are assembled, the tab 34 is substantially vertically centered between the opposing sides of the nock. Thus, the sight tab 34 is also defined by an upper shoulder or edge 37 which is adapted to receive a lower edge of the component part 16 as described below.

Turning now to FIGS. 4 and 5, the component part 16 also includes a flat face 40 formed with a smooth bore aperture 42 which is located so as to axially align with the aperture 20 when the component parts 14 and 16 are assembled as shown in FIGS. 1 and 2. The component part 16 is also formed with a half groove 44 adjacent the assembly face 40 on one side, and adjacent the forward edge 26' on the other side. The half groove 44 is similar to the half groove 22 and is adapted to be aligned therewith when the component parts are assembled so as to firmly grip the bowstring 12 therebetween. Note here that the half groove 44 is also formed with detents 46, 48 which are generally similar to the detents 28 and 30 described earlier. This feature is significant in that when the component parts 14 and 16 are assembled, the detent portions 28, 30, 46 and 48 bite into the bowstring so that the bowstring 12 is firmly gripped within the cooperating half grooves, and the possibility of any sliding movement along the bowstring is precluded.

Referring to FIGS. 5 and 6, near the rearward end of the component part 16, a squared, offset edge 50 is defined by surfaces 52 and 54 such that surface 52 abuts the flat mounting face 18 of component part 14 as best seen in FIG. 6. The lateral offset created by surface 56 establishes a gap 58 between the component parts 14 and 16, extending from the offset surface 56 to the pair of half grooves 22 and 44. The advantage to this construction will be explained in greater detail below.

Figure 7:
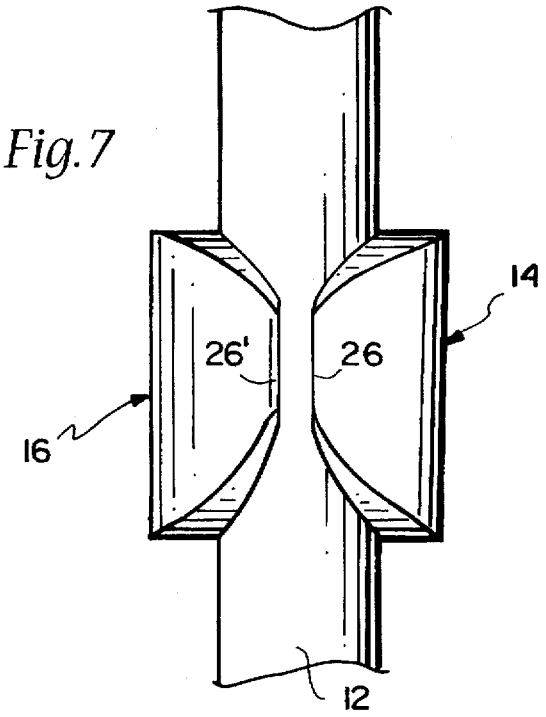
FIG. 7 is a front elevation of FIG. 6.
Figure 8:
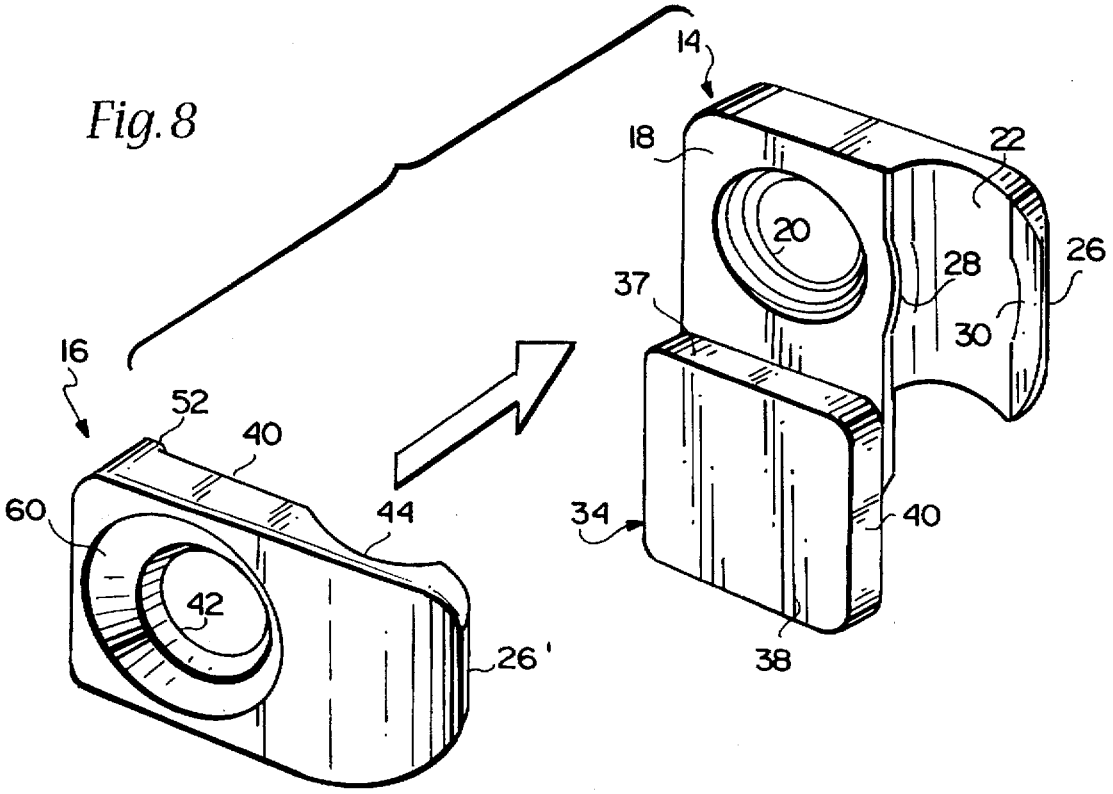
FIG. 8 is a plan view of the assembled nock.

With reference now to FIG. 8, it will be appreciated that the component part 16 is countersunk at 60 to receive the enlarged head of a fastening screw S by which the component parts 14 and 16 are secured together. It is important to note here that the half grooves 42 and 44 are not exactly semi-circular so that when the component parts are assembled, a gap 62 remains which is in substantially diametrically opposed relationship to the previously described gap 58. With this arrangement, when the screw is tightened to fasten the component parts 14 and 16 together, the half grooves 22 and 44 will be resiliently clamped onto the bowstring in the manner illustrated in FIGS. 1 and 7. As a result of this resilient or flexible clamping action, a resilient tension or bias is also placed on the screw fastener, precluding loosening of the screw during operation.

Figure 9:
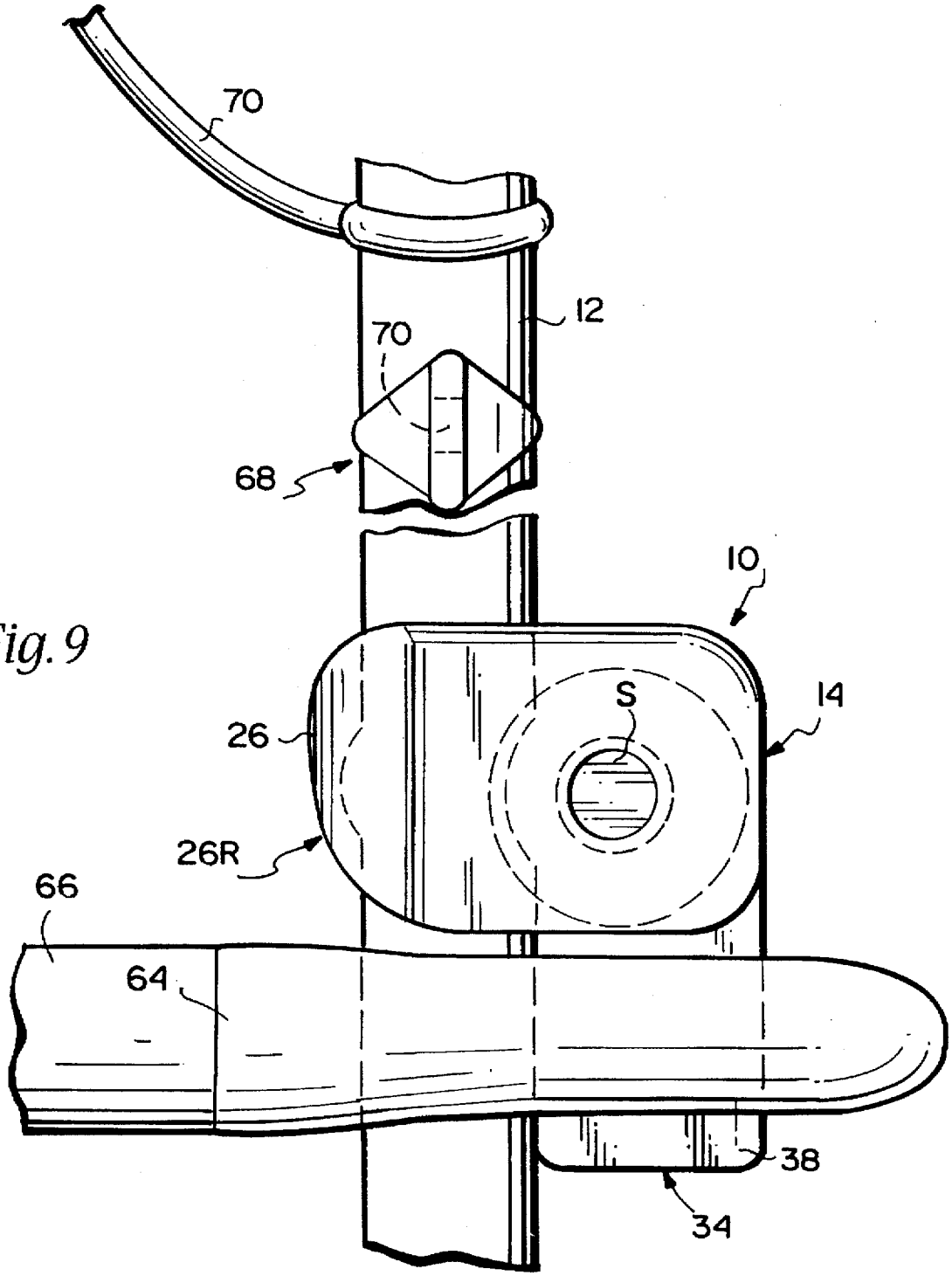
FIG. 9 is a partial side elevation showing the nock mounted on a bowstring, showing a peep sight device and an arrow in place prior to firing.

As best seen in FIGS. 3 and 9, the forward edge of the bowstring nock indicated by reference numerals 26 and 26', is formed with a larger radius adjacent that edge which is closest to the arrow nock. More specifically, the lower portion 26R of the forward edge 26 is radiused so as to eliminate any possibility of biting action between the bowstring nock 10 and the arrow nock 64, as otherwise might occur if the bowstring nock were formed with a sharply delineated forward edge. In a preferred embodiment, the radius is at least about 0.10 inch.

FIG. 9 also illustrates the overall relationship between the bowstring nock 10, the arrow nock 64 at the rearward end of the arrow 66 and the bowstring 12. The latter has attached thereto a peep sight device 68 having a sight aperture 70. FIG. 9 also illustrates a conventional rubber tube 70 attached to the bowstring 12 and which, as previously mentioned, has been used to keep the bowstring 12 from rotating during a draw and thus maintain the proper alignment of the peep sight device 68. In accordance with this invention, the archer aligns the peep sight device 68 with the tab 34 when the bowstring nock 10 is secured to the bowstring 12. With the bowstring nock 10 so mounted, the peep sight device 68 will generally be maintained in proper alignment as the bowstring 12 is pulled to a fully drawn position. However, since there is some amount of play between the slot in the arrow nock and the tab 34 of the bowstring nock 10, there may be some slight rotation of the bowstring 12 as the string is drawn rearwardly. If this phenomenon is experienced, the archer can then adjust the bowstring nock 10 by loosening the screw S and rotating the nock in the appropriate direction by an amount approximately equal to the amount of rotation of the bowstring 12 experienced by the archer. This, then, compensates for such rotation so that when the bowstring 12 is drawn rearwardly to the fully drawn position, the peep sight 68 will be in the proper rotational position, allowing the archer to fully sight the target.

Thus, the bowstring nock 10 in accordance with this invention performs no fewer than three functions: It serves the traditional function of a bowstring nock in that it locates the arrow nock 64 of the arrow 66 at the proper location along the bowstring 12. At the same time, the tab 34 facilitates alignment of the peep sight device 68, and the tab 34 also serves to align and hold the arrow nock 64 in its proper orientation.

Figure 10:
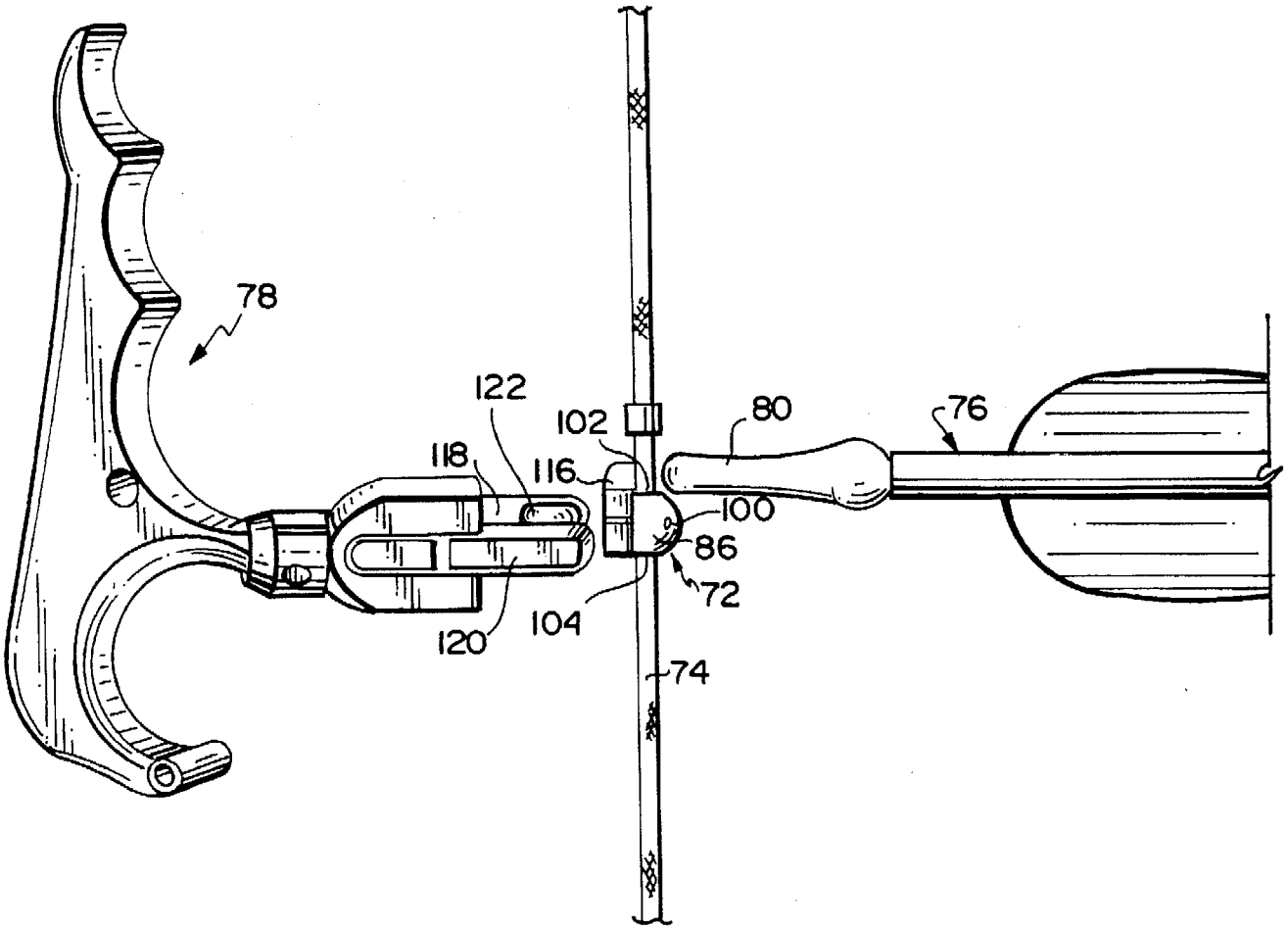
FIG. 10 is a side elevation showing a single ball release nock in accordance with another embodiment of the invention, with an associated release device.

Turning to FIG. 10, a single ball release nock 72 is shown attached to a bowstring 74, and illustrating the orientation of an arrow 76 and a single ball release device 78 relative to the single ball release nock 72. The ball release nock 72 is secured to the bowstring 74 just below the point where the arrow nock 80 engages the bowstring 74 so as to vertically locate and support the former. The illustrated release device grips the ball release nock in the manner described in co-pending application Ser. No. 08/395,435.

Figure 11:
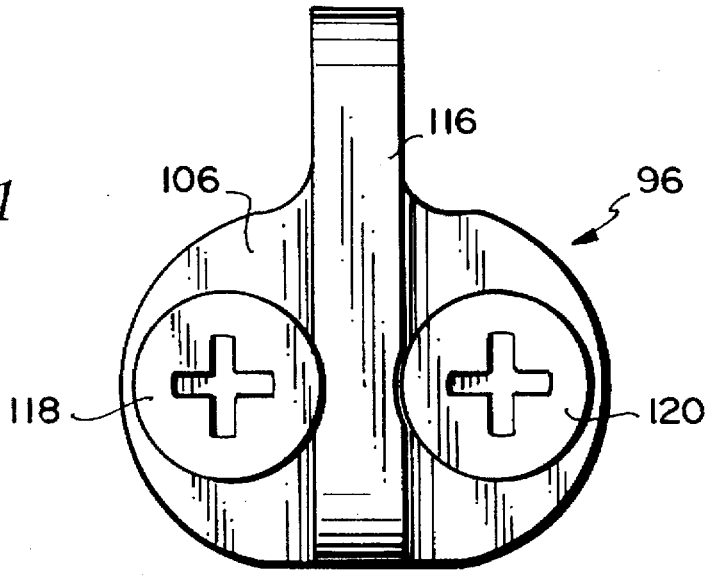
FIG. 11 is a rear elevation of the single ball nock.
Figure 12:
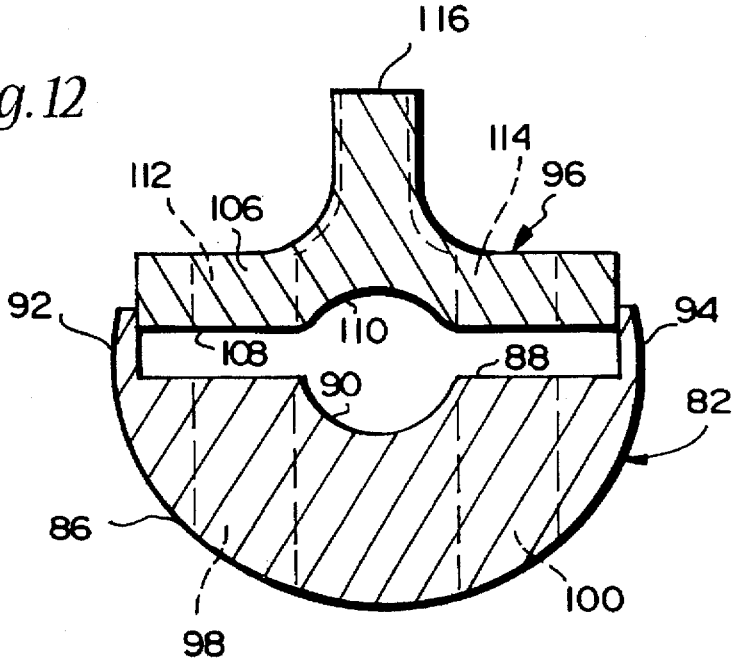
FIG. 12 is a sectional view illustrating the manner of attachment of the ball and alignment tail portions of the single ball nock.
Figure 13:
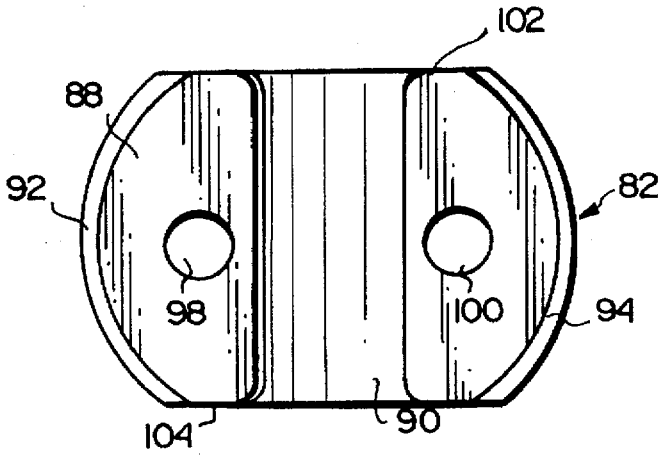
FIG. 13 is a plan view of the ball portion of the nock shown in FIG. 12.

The two-piece construction of the release nock 72 is shown more particularly in FIGS. 11–13. The ball portion 82 is substantially semi-spherical in shape, including a spherical outer surface 86 and a flat engagement surface 88, bifurcated by a central groove 90. At both ends of the ball portion 82, there are upstanding curved tabs 92, 94 which facilitate and enable interfitting engagement with the alignment tail portion 96 described in greater detail below. A pair of fastener holes 98, 100 extend through the ball portion 82, perpendicular to the flat surface 88. It should also be noted that upper and lower surfaces 102, 104 of the ball portion are also flattened, as best seen in FIGS. 10 and 13.

The alignment tail portion 96 includes a cap 106 which is sized and shaped to seat on the flat surface 88 of the ball portion 82, between the upstanding tabs 92, 94. The underside of the portion 96 thus has a flat surface 108 adapted to sit on the surface 88, with a groove 110 adapted to align and cooperate with groove 90 to form an elongated hole through which the bowstring passes (see FIG. 10).

The cap portion is also provided with a pair of fastener holes 112, 114 which align with similar holes 98, 100 when the respective parts are assembled about the bowstring. Between the fastener holes 98, 100, there is an alignment tail 116 which extends in the same direction as cooperating grooves 90, 110, i.e., adjacent and along the bowstring. The tail 116 extends along the cap 106 and projects beyond the cap in the upward direction as viewed in FIGS. 10 and 11. Because the projecting portion of the tail 116 is also aligned with the bowstring 74 and is slightly smaller in thickness than the diameter of the bowstring, the tail 116 does not interfere with the positioning of the arrow nock 80 on the release nock 72. Of course, the thickness of the tail 116 is also less than the space between the split halves of the arrow nock 80.

The manner in which the ball portion 82 and alignment tab portion 96 are assembled is shown in FIG. 12, it being understood that the bowstring 74 will be sandwiched (i.e., tightly gripped) between the ball portion and the alignment tab portion. In this regard, the cooperating grooves 90, 110 together do not form a completely round hole and, therefore, the substantially round bowstring 74 is securely clamped therebetween when screw fasteners 118, 120 are inserted and tightened.

By aligning the peep sight visually with the tail 116 of the nock 72, a more accurate set-up procedure is enabled. In use, the release nock 72 may be utilized with a single ball release device 78 as shown in FIG. 10, and which includes gripper arms 118, 120, each having a substantially semi-spherical socket or jaw (one shown at 122) which is adapted to engage the ball portion 82 of the bowstring nock 72 in the manner described in the '435 application, thus reducing bowstring wear.

Figure 14:
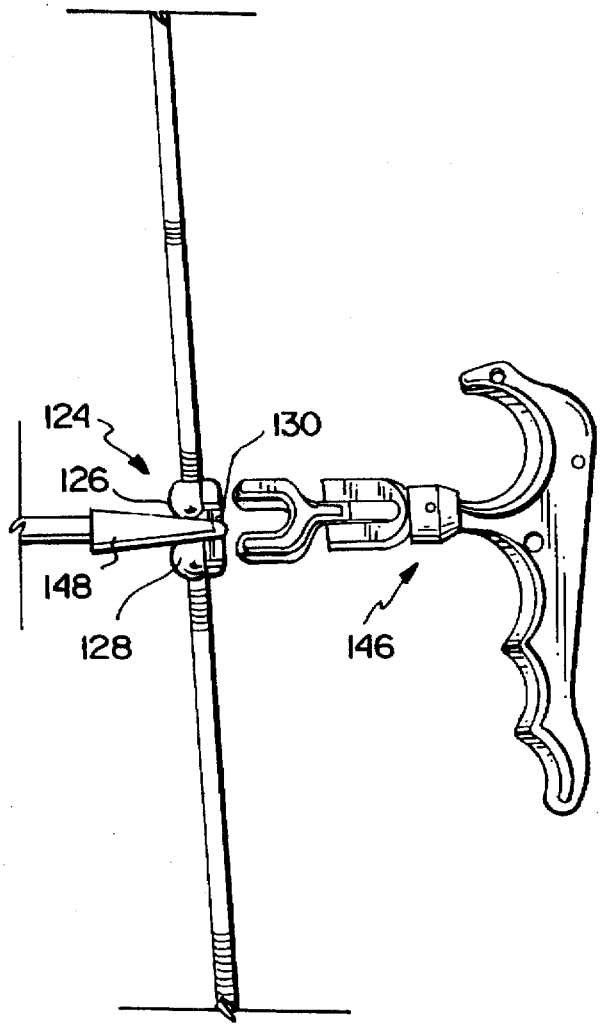
FIG. 14 is a side elevation showing a double ball release nock in accordance with another embodiment of the invention, with an associated release device.

FIG. 14 discloses a double ball release nock 124 which is similar to the single ball release nock 72, except that a pair of ball release portions 126, 128 are connected by a single, extended alignment tail 130. More specifically, and with reference to FIG. 15, the alignment tail portion 132 includes a pair of cap portions 134, 136, connected by the vertically oriented, integral alignment tail 130. Each cap portion 134, 136 is substantially identical to the previously described cap 96. The double cap in this instance is adapted to receive the discrete ball portions 126, 128, each of which is substantially identical to the ball portion 82 previously described (and shown in FIG. 13). Assembly is as shown in FIG. 12 but it will be appreciated that four fasteners are employed, with a pair of fastener holes 138, 140 and 142, 144 provided in each cap portion, respectively, for receiving screw fasteners as shown in FIG. 11.

Figure 15:
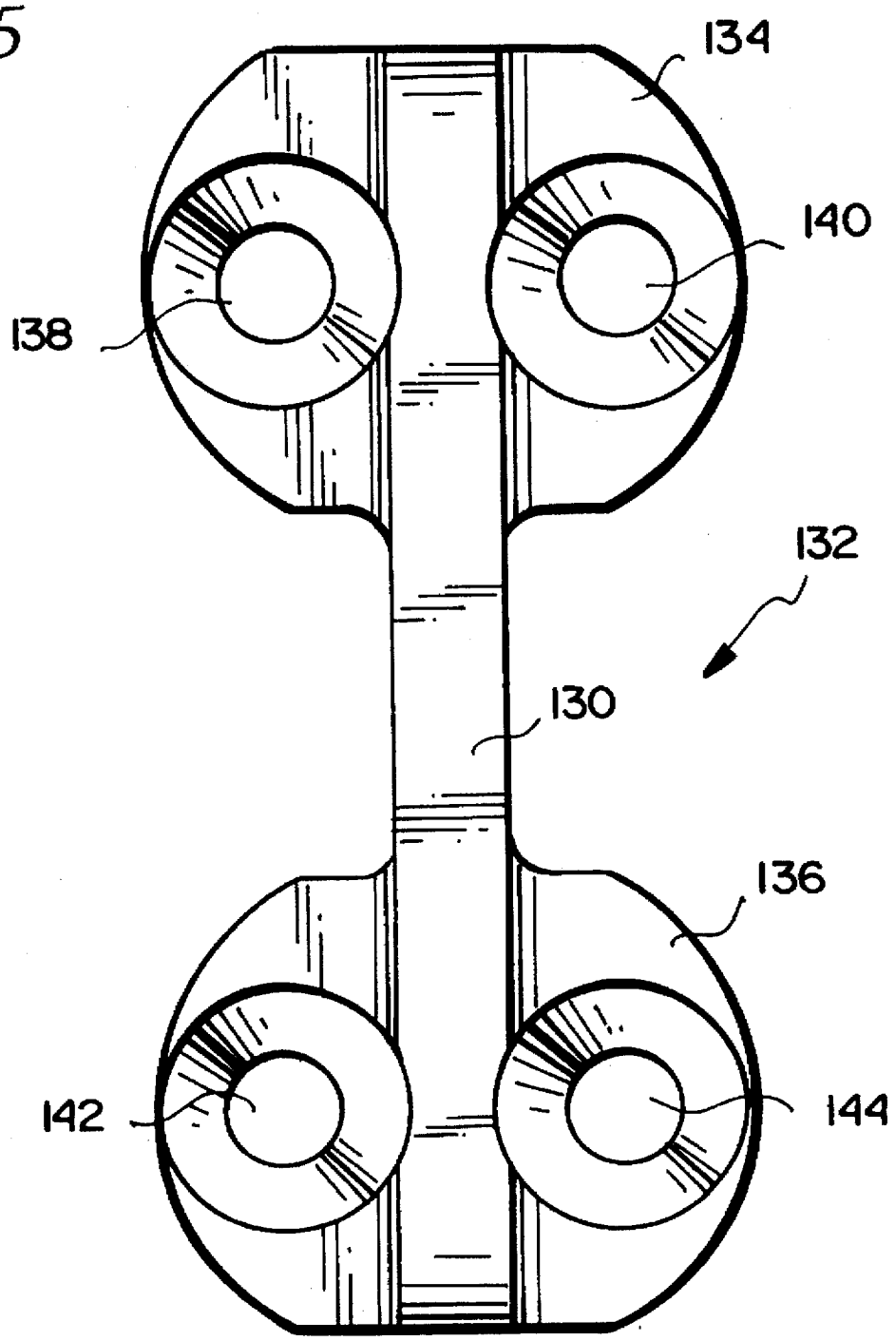
FIG. 15 is a rear elevation of the double ball release shown in FIG. 14, but with fastener screws omitted.

The double ball release nock is adapted for use with a double ball release 146 as shown in FIG. 15 and as disclosed in the '537 application. This release includes a pair of jaws for gripping each of the ball portions as described in more detail in the '537 application. Note that the integral alignment tail 130 extending between the ball portions 126, 128 of the nock 124 is sufficiently long that the arrow nock 148 can be accurately located between the ball portions 126, 128 without interference from the latter.

As in the case of the single ball nock, the archer is now enabled to align the peep sight on the bowstring with the alignment tail or cross bar 130 to thereby maintain proper rotational alignment.

Both single and double ball nocks may be used with various sizes of bowstrings in light of the non-round profile of the bowstring holes in the nocks. The nocks are also preferably formed from CNC machined 7075 aircraft aluminum to reduce wear and increase life.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A ball release nock for a bowstring adapted for use with a bowstring release device, said ball release nock comprising:

a first ball portion having a first bowstring groove extending in a first direction;

an alignment tail portion adapted for interengagement with said ball portion and having a second bowstring groove adapted to cooperate with said first bowstring groove to form an elongated bowstring aperture; and wherein said alignment tail portion includes a tail projecting in a direction parallel to said bowstring aperture and extending beyond said ball portion in said first direction.

2. The ball release nock of claim 1 including a pair of fastener holes on either side of said tail, extending perpendicular to said tail, in said ball portion and said tail portion.

3. The ball release nock of claim 1 wherein said ball portion is substantially semi-spherical in shape and includes a pair of upwardly directed tabs facilitating seated engagement with said alignment tail portion.

4. The ball release nock of claim 1 wherein said nock is constructed of metal or plastic material.

5. The ball release nock of claim 1 wherein said bowstring aperture is non-round.

6. The ball release nock of claim 1 in combination with a peep sight mounted on said bowstring.

7. The ball release nock of claim 1 including a second ball portion connected to said first ball portion by said alignment tail portion.

8. A ball release nock for a bowstring adapted for use with a bowstring release device, said ball release nock comprising:

a first ball portion having a first bowstring groove extending in a first direction;

a second ball portion having a second bowstring groove extending in said first direction;

an alignment tail portion including first and second cap portions at opposite ends of said tail portion, each cap portion having a groove for cooperation with said first and second bowstring grooves, respectively, to thereby form a pair of spaced bowstring apertures, said first and second cap portions each adapted to receive a corresponding one of said first and second ball portions.

9. The ball release nock of claim 8 wherein each said ball portion is substantially semi-spherical in shape and each includes a pair of upwardly directed tabs facilitating seated engagement with said cap portion.

10. The ball release nock of claim 8 wherein said nock is constructed of aluminum.

11. The ball release nock of claim 8 wherein said bowstring apertures are non-round.

12. The bah release nock of claim 8 wherein a pair of fasteners connect each cap portion to each respective ball portion.

* * * * *